US008984999B2

(12) United States Patent
Frick

(10) Patent No.: US 8,984,999 B2
(45) Date of Patent: Mar. 24, 2015

(54) PROGRAMMABLE AMMUNITION

(75) Inventor: Henry Roger Frick, Hettlingen (CH)

(73) Assignee: Rheinmetall Air Defence AG, Zurich (CH)

( * ) Notice: Subject to any disclaimer, the term of this patent is extended or adjusted under 35 U.S.C. 154(b) by 130 days.

(21) Appl. No.: 13/563,165

(22) Filed: Jul. 31, 2012

(65) Prior Publication Data

US 2014/0007759 A1 Jan. 9, 2014

Related U.S. Application Data

(63) Continuation of application No. PCT/EP2011/000389, filed on Jan. 28, 2011.

(30) Foreign Application Priority Data

Feb. 1, 2010 (DE) ..... 10 2010 006 530

(51) Int. Cl.
*F42C 17/04* (2006.01)
*F42C 11/06* (2006.01)
*F42C 11/00* (2006.01)

(52) U.S. Cl.
CPC ..... *F42C 11/065* (2013.01); *F42C 11/008* (2013.01); *F42C 17/04* (2013.01)
USPC ..... 89/6.5; 102/206; 102/209; 102/214; 102/215

(58) Field of Classification Search
USPC ..... 89/6.5; 102/206, 207, 209, 210, 212, 102/214, 215
See application file for complete search history.

(56) References Cited

U.S. PATENT DOCUMENTS

| | | | | | |
|---|---|---|---|---|---|
| 2,691,761 | A | * | 10/1954 | Smith, Jr. | 342/105 |
| 2,824,284 | A | * | 2/1958 | Johnson | 342/104 |
| 3,994,228 | A | | 11/1976 | Hürlimann | |
| 4,005,658 | A | | 2/1977 | Karayannis | |
| 4,030,097 | A | * | 6/1977 | Gedeon | 342/115 |
| 4,044,682 | A | | 8/1977 | Karayannis | |
| 4,116,133 | A | | 9/1978 | Beuchat | |
| 4,138,946 | A | | 2/1979 | Postler et al. | |
| 4,142,442 | A | | 3/1979 | Tuten | |
| 4,144,815 | A | | 3/1979 | Cumming et al. | |
| 4,280,410 | A | | 7/1981 | Weidner | |
| 4,283,989 | A | * | 8/1981 | Toulios et al. | 89/6.5 |
| 4,495,851 | A | | 1/1985 | Koerner et al. | |

(Continued)

FOREIGN PATENT DOCUMENTS

| | | |
|---|---|---|
| CH | 586 384 | 3/1977 |
| CH | 586 889 | 4/1977 |

(Continued)

*Primary Examiner* — Michael David
(74) *Attorney, Agent, or Firm* — Muncy, Geissler, Olds & Lowe, P.C.

(57) ABSTRACT

A programmable ammunition which receives a program as well as energy transmission is provided. The ammunition also comprises an energy store, an electronic system and an ignition in addition to at least one sensor for capturing the signal emitted for the program, the signal having a frequency which is transmitted further to the electronic system. The ammunition is also combined with an energy transfer unit in such a manner that an additional signal having a frequency is guided to the energy unit by the same the sensor and/or an additional sensor and is charged. Programming and the energy transmission occurs when the projectile passes through a weapon barrel, a muzzle brake or similar which is operated as a waveguide below the threshold frequency.

2 Claims, 5 Drawing Sheets

(56) References Cited

U.S. PATENT DOCUMENTS

| | | | | |
|---|---|---|---|---|
| 4,649,796 | A | 3/1987 | Schmidt | |
| 4,862,785 | A | 9/1989 | Ettel et al. | |
| 4,928,523 | A * | 5/1990 | Muhrer et al. | 73/167 |
| 5,787,785 | A | 8/1998 | Muenzel et al. | |
| 5,894,102 | A | 4/1999 | Oberlin et al. | |
| 6,598,533 | B1 | 7/2003 | Kölbli | |
| 7,506,586 | B1 | 3/2009 | Pereira et al. | |
| 7,825,850 | B2 | 11/2010 | Frick | |
| 8,305,071 | B2 * | 11/2012 | Frick | 324/160 |
| 8,746,119 | B2 * | 6/2014 | Frick | 89/6.5 |
| 2007/0074625 | A1 | 4/2007 | Seidensticker et al. | |
| 2008/0211710 | A1 | 9/2008 | Frick | |
| 2009/0289619 | A1 | 11/2009 | Frick | |
| 2010/0308152 | A1 | 12/2010 | Seidensticker | |

FOREIGN PATENT DOCUMENTS

| | | | |
|---|---|---|---|
| CH | 691 143 | A5 | 4/2001 |
| DE | 488 866 | | 12/1929 |
| DE | 25 18 266 | | 11/1975 |
| DE | 25 39 541 | | 3/1977 |
| DE | 26 53 241 | | 6/1977 |
| DE | 77 02 073 | U1 | 4/1978 |
| DE | 28 47 548 | | 5/1980 |
| DE | 31 50 172 | A1 | 6/1983 |
| DE | 199 41 301 | C1 | 12/2000 |
| DE | 698 11 187 | T2 | 7/2003 |
| DE | 103 41 713 | B3 | 6/2005 |
| DE | 197 56 357 | B4 | 6/2007 |
| DE | 10 2006 058 375 | A1 | 6/2008 |
| DE | 10 2007 007 404 | A1 | 8/2008 |
| DE | 10 2009 024 508 | A1 | 7/2011 |
| EP | 0 300 255 | A1 | 1/1989 |
| EP | 0 769 673 | B1 | 3/2002 |
| EP | 0 919 783 | B1 | 2/2003 |
| EP | 1 726 911 | A1 | 11/2006 |
| WO | WO 2008/067876 | A1 | 6/2008 |
| WO | WO 2009/085064 | A2 | 7/2009 |
| WO | WO 2009/141055 | A1 | 11/2009 |

* cited by examiner

PROGRAMMABLE AMMUNITION

This nonprovisional application is a continuation of International Application No. PCT/EP2011/000389, which was filed on Jan. 28, 2011, and which claims priority to German Patent Application No. DE 10 2010 006 530.7, which was filed in Germany on Feb. 1, 2010, and which are both herein incorporated by reference.

BACKGROUND OF THE INVENTION

1. Field of the Invention

The present invention relates to the challenge of programming a projectile during passage through the barrel or the like. In addition, provision is also made for implementing the transmission of energy to the projectile during passage through the barrel, etc.

2. Description of the Background Art

For programmable ammunition, information must be communicated to the projectile—which is to say programmed into it—concerning its detonation time and/or flight path. In systems in which the detonation time is calculated from the measured muzzle velocity $V_0$, the information can be relayed no earlier than at the muzzle and/or in flight. If the programming takes place prior to exit from the gun barrel, as a general rule the projectile flies past a programming unit at the muzzle velocity $V_0$ and thus is in motion relative to the programming unit.

A known programming unit is described in CH 691 143 A5. With the aid of a transmitting coil, the information is transmitted inductively via a matching coil in/on the projectile. Aside from the heavy construction of the programming unit, an unshielded transmitting coil can result in unwanted radiation, since the coil also acts as an antenna. The radiated signal can be detected, and conclusions concerning the location of the gun can be drawn therefrom.

A method is known from WO 2009/085064 A2 in which the programming is undertaken by the transmission of light beams. To this end, the projectile has optical sensors on its circumference.

DE 10 2009 024 508.1, which corresponds to U.S.20100308152, concerns a method for correcting the trajectory of a round of terminal phase-guided ammunition, specifically with the projectile imprinting of such projectiles or ammunition in the medium caliber range. It is proposed therein to separately communicate with each individual projectile after a firing burst (continuous fire, rapid individual fire) and in doing so to transmit additional information regarding the direction of the earth's magnetic field for the individual projectile. The projectile imprinting takes place using the principle of beam-riding guidance of projectiles. In this process, each projectile reads only the guide beam intended for that projectile, and can determine its absolute roll attitude in space using additional information, in order to thus achieve the correct triggering of the correction pulse.

Alternative transmission possibilities, for example by means of microwave transmitters, are known to those skilled in the art from EP 1 726 911 A1, which corresponds to U.S. 20070074625.

While programming during flight is indeed technically possible as a result, it nevertheless is also subject to simple interference.

For programmable ammunition, energy must be provided to the projectile for the electronics integrated therein and for starting of the detonating train. For this purpose, various rounds of ammunition have small batteries that supply the requisite energy. Others are programmed and supplied with energy before firing. If the energy quantity is available continuously, for example during storage or the process of loading in the weapon, undesired explosion of the projectile may occur in the event of a malfunction in the electronics. For this reason, the use of simple energy storage devices such as a battery is not always appropriate.

It is thus recommended for safety reasons to provide the energy to the projectile in close temporal proximity to firing, for example after the ignition of a propellant charge and before leaving the muzzle opening of a gun barrel. This ensures that the round of ammunition cannot detonate itself before firing, as it has no energy.

The battery from DE 31 50 172 A, which corresponds to U.S. Pat. No. 4,495,851, is not activated until after the projectile has left the gun barrel, which is accomplished by means that include a mechanical timer. The battery in DE 199 41 301 A, which corresponds to U.S. Pat. No. 6,598,533, also is first activated by high accelerations during firing.

According to DE 488 866, a capacitor of the detonator is charged via external contacts in the firing position. According to the teaching in DE 10 2007 007 404 A, an ignition capacitor is charged as early as following the end of muzzle safety, which is to say approximately two seconds before the end of the flight time. The ignition capacitor according to DE 26 53 241 A, which corresponds to U.S. Pat. No. 4,116,133, is charged inductively via magnet coils before firing.

U.S. Pat. No. 4,144,815 A describes a type of energy transmission device in which the gun barrel serves as a microwave guide, so that the energy and the data are transmitted prior to firing. A receiving antenna on the detonator receives the radiated signal and directs it through a changeover switch to either a rectifier device or a filter acting as a demodulator that filters the data out of the incoming signal. The rectifier device in this design serves to produce a supply voltage, which is then stored, from the incoming signal.

Also known are devices that obtain the energy from the kinetic energy of the projectile. Here, a mechanism is built into the projectile that converts the required energy from the acceleration following ignition of the propellant charge into electromagnetic energy, and in so doing charges a storage device located in the projectile.

CH 586 384 A, which corresponds to U.S. Pat. No. 4,044,682, describes a method in Which a soft iron ring and a ring-shaped permanent magnet are displaced in the direction of the projectile axis relative to an induction coil as a result of the linear projectile acceleration, by which means a voltage that charges a capacitor is generated in the coil. For the sake of safety, this unit is then provided in CH 586 889 A, which corresponds to U.S. Pat. No. 4,005,658, with a transport safety device that is destroyed only by the, or a, high acceleration during firing.

It can be a disadvantage here that the acceleration of the projectile in the gun barrel is used, since this cannot be controlled with exact precision. This causes the energy charging to vary, so that the projectile is given too much or even too little energy in its travel. Too little energy then has the disadvantage that functionality is not guaranteed. A further disadvantage is the complex and thus space-consuming conversion mechanism for converting mechanical energy into electromagnetic energy. Moreover, with the extreme environmental influences (shocks during firing, transverse accelerations and spin) on the projectile during firing, this mechanism can be destroyed. In order to preclude this, design measures are necessary that not only make the round of ammunition costlier, but also require additional space in the projectile and make it heavier.

Generators in the projectile head are proposed in DE 25 18 266 A, which corresponds to U.S. Pat. No. 3,994,228, and DE 103 41 713 A. An alternative to these is the use of piezo crystals, as proposed and implemented in DE 77 02 073 A (which corresponds to U.S. Pat. No. 4,138,946), DE 25 39 541 A or DE 28 47 548 A (which corresponds to U.S. Pat. No. 4,280,410).

In this context, the latter proposals already take the route of replacing prior art energy conversion mechanisms with an energy transmission system that for its part impresses the necessary energy on the projectile no later than during passage through the muzzle opening.

SUMMARY OF THE INVENTION

It is therefore an object of the invention to provide a projectile that allows for optimal programming and/or optimal energy transmission with simple construction.

In an embodiment of the invention, the programming and energy transmission is performed inductively and/or capacitively. To this end, the projectile contains a sensor that receives the programming signal, as well as a processor that is electrically connected to this sensor and that performs the programming and thereby initiates detonation of the projectile at a predetermined point in time. An electrical storage device serves to supply power to the electronics of the processor. In the preferred embodiment, this storage device receives its energy during passage through a gun barrel and/or a muzzle brake.

In an embodiment, the part that is used as a waveguide—the gun barrel, muzzle brake, or additional part between gun barrel and muzzle brake, and a part that can be attached to the muzzle brake—is operated below the cutoff frequency. From DE 10 2006 058 375 A, which corresponds to U.S. Pat. No. 7,825,850, and which are incorporated herein by reference, such a method with device is already known for measuring the muzzle velocity of a projectile or the like. This document proposes using the gun barrel or launcher tube and/or parts of the muzzle brake as a waveguide (a tube with a characteristic cross-sectional shape that has a wall with very good electrical conductivity is considered a waveguide. Primarily square and round waveguides are widely used as a technology), which, however, is operated below the cutoff frequency of the applicable waveguide mode. WO 2009/141055 A, which corresponds to U.S. 20090289619, and which are incorporated herein by reference, carries this idea further and combines two methods of measuring $V_0$.

Further scope of applicability of the present invention will become apparent from the detailed description given hereinafter. However, it should be understood that the detailed description and specific examples, while indicating preferred embodiments of the invention, are given by way of illustration only, since various changes and modifications within the spirit and scope of the invention will become apparent to those skilled in the art from this detailed description.

BRIEF DESCRIPTION OF THE DRAWINGS

The present invention will become more fully understood from the detailed description given hereinbelow and the accompanying drawings which are given by way of illustration only, and thus, are not limitive of the present invention, and wherein.

DETAILED DESCRIPTION

Figure 1:
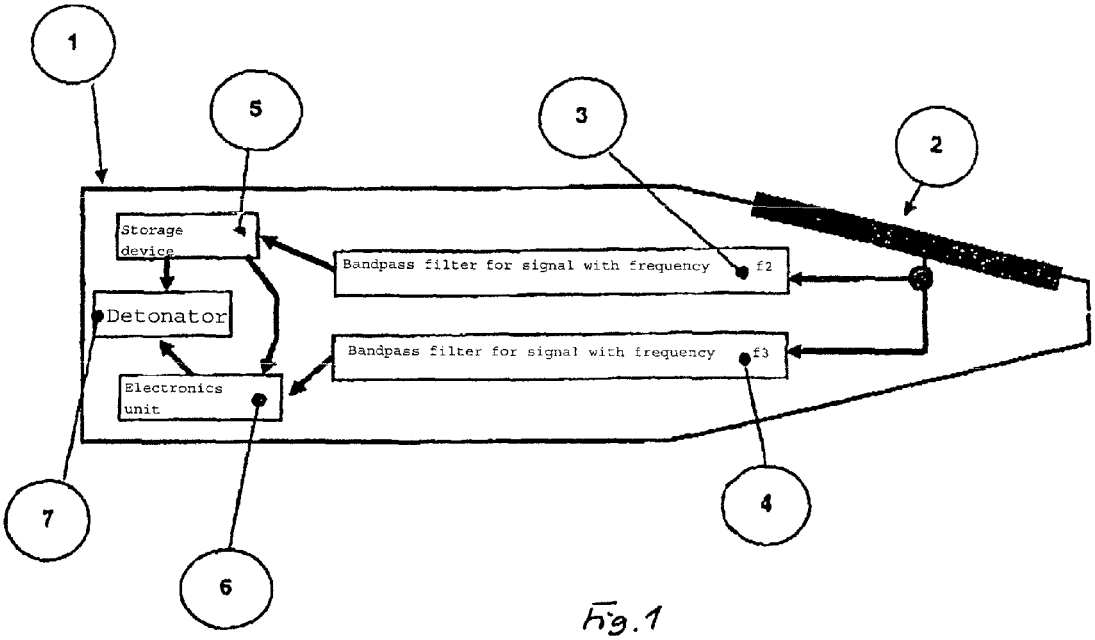
FIG. 1 is a programmable round of ammunition in a first variant with bandpass filter.
Figure 2:
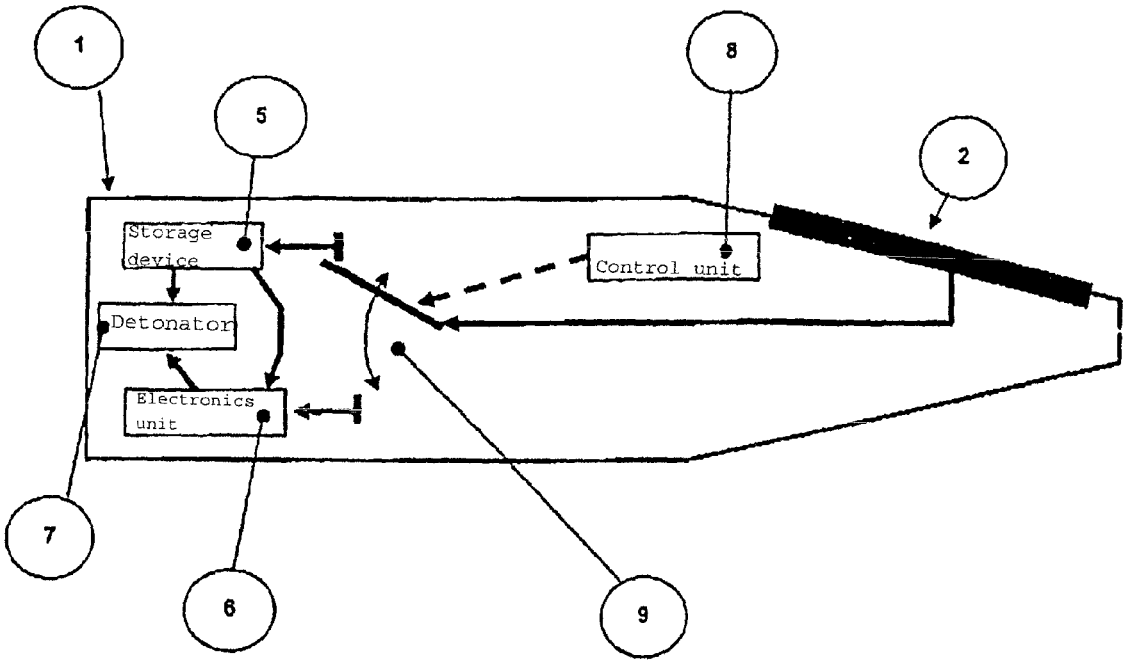
FIG. 2 is the programmable round of ammunition from FIG. 1 with an energy path connected.
Figure 3:
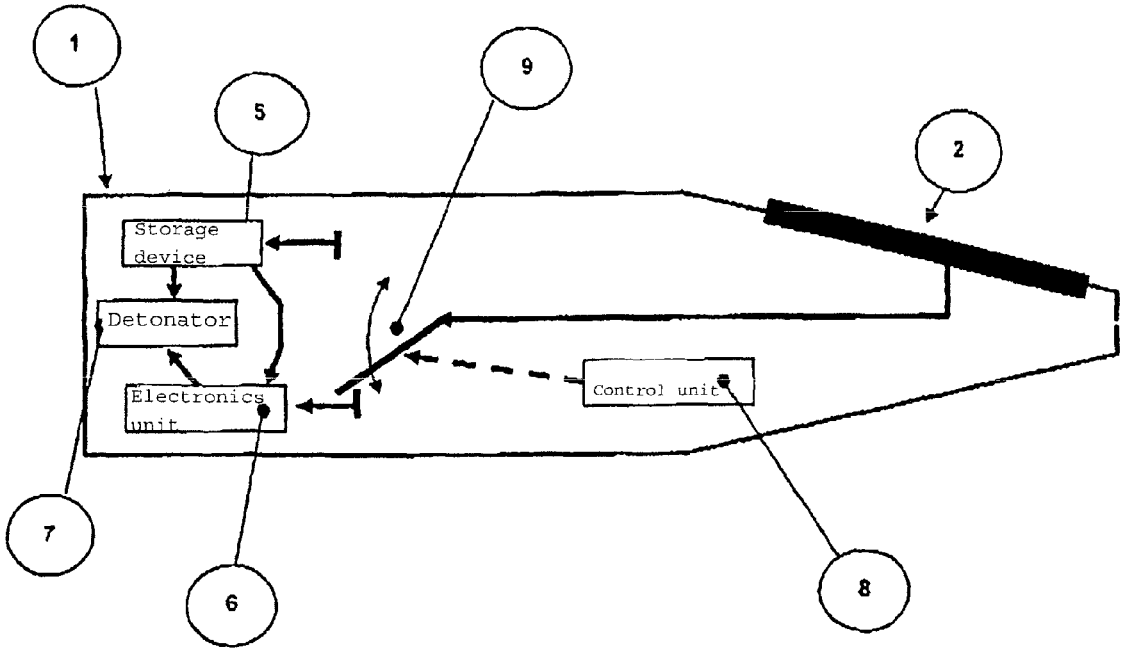
FIG. 3 is the programmable round of ammunition from FIG. 2 with a programming path connected.

FIG. 1 through 3 show a projectile or round of ammunition 1 with at least one sensor 2 for receiving a programming signal with the frequency $f_3$ and/or an energy transmission signal with the frequency $f_2$. The sensor can be, for example, a coil for an inductive signal transmission and/or an electrode for a capacitive signal transmission. The number 7 labels a detonator (electric), which is electrically connected to an electronics unit (processor) 6 and to an energy storage device 5. The signal with the frequency $f_2$ supplies the energy storage device 5 with energy, and the signal with the frequency $f_3$ programs the electronics unit 6, for example with the detonation time. The energy storage device 5 supplies power to the electronics unit 6 and the detonator 7.

In the exemplary embodiment, the energy transmission can be tuned to the signal of the programming. In this design in FIG. 1, the programming signal with frequency $f_3 \neq f_2$ is used so that the same sensor 2 can be used for both processes in order to save space. Thus, in this preferred embodiment, only one sensor 2 is used for the programming as well as for an energy transmission to provide energy for the storage device 5 in the projectile 1. This is also supported by the means that the energy transmission takes place during passage of the projectile 1 through a gun barrel, a muzzle brake, etc., and the programming takes place chronologically after this energy transmission. It is also possible of course to use two separate sensors and to connect them in a fixed manner.

In accordance with the exemplary embodiment in FIG. 1, the energy input (energy transmission) at the projectile 1 takes place through the reception of a frequency $f_2$, and the programming takes place through the reception of a frequency $f_3$. Since a common receiving sensor 2 is used for both frequencies, a bandpass filter 3, 4 is incorporated which passes the signal with the frequency $f_2$ through to the storage device 5, and also passes the signal with the frequency $f_3$ through to the electronics unit 6. The two bandpass filters 3, 4 thus separate the received signals based on their frequencies.

In another embodiment from FIG. 2 and FIG. 3 (condition can be $f_2 \neq f_3$ or $f_2 = f_3$), a control unit 8 is incorporated in place of the bandpass filters 3, 4; this control unit arranges a switchover to the individual paths—energy path and programming path—by means of a switch 9 or the like. In this context, FIG. 2 shows the connection to the storage device 5 of the energy path, and FIG. 3 shows the connection of the sensor 2 to the electronics unit 6 of the programming path.

Figure 4:
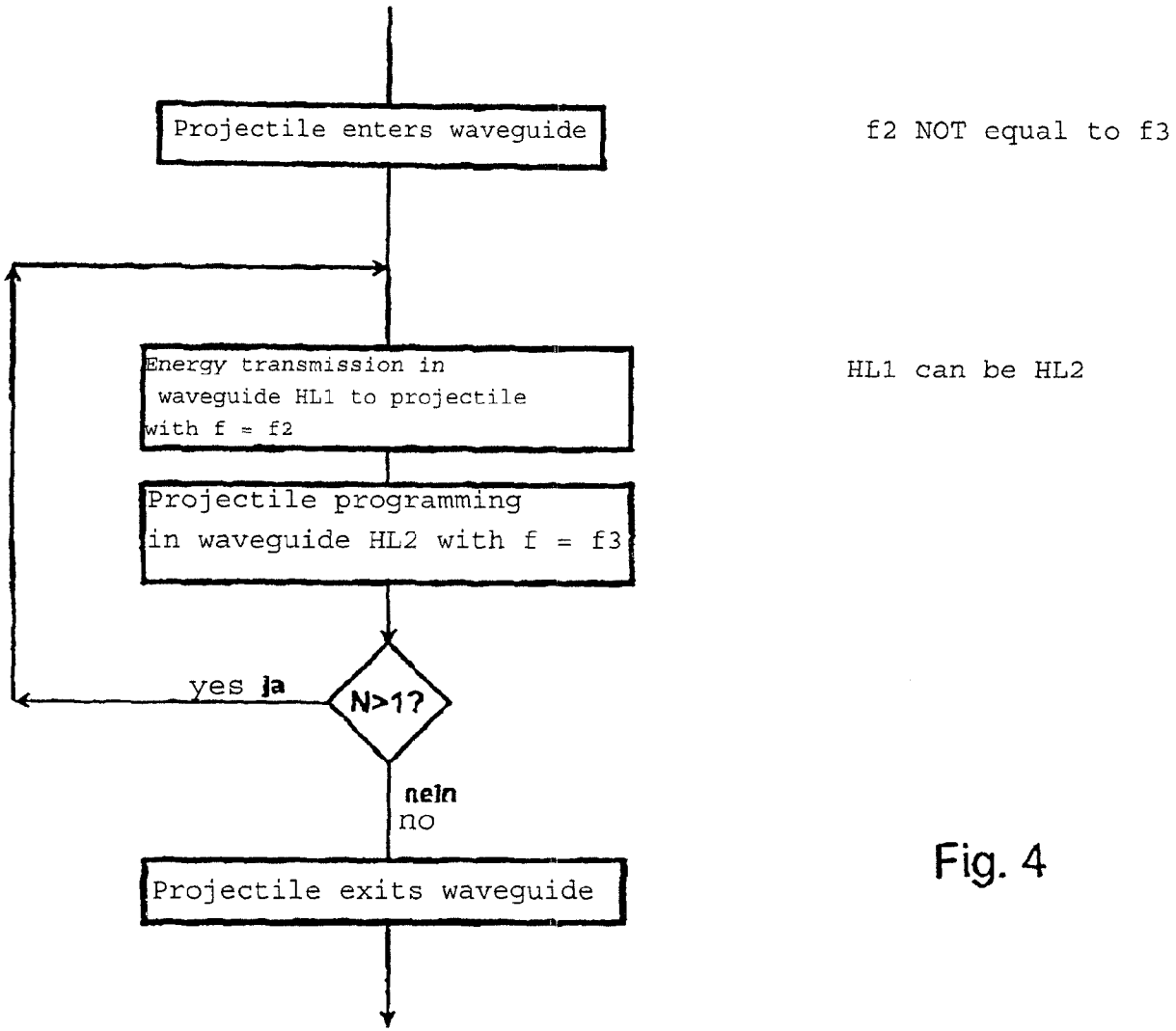
FIGS. 4 and 5 are flowcharts of the programming of or of the energy transmission to the round of ammunition.
Figure 5:
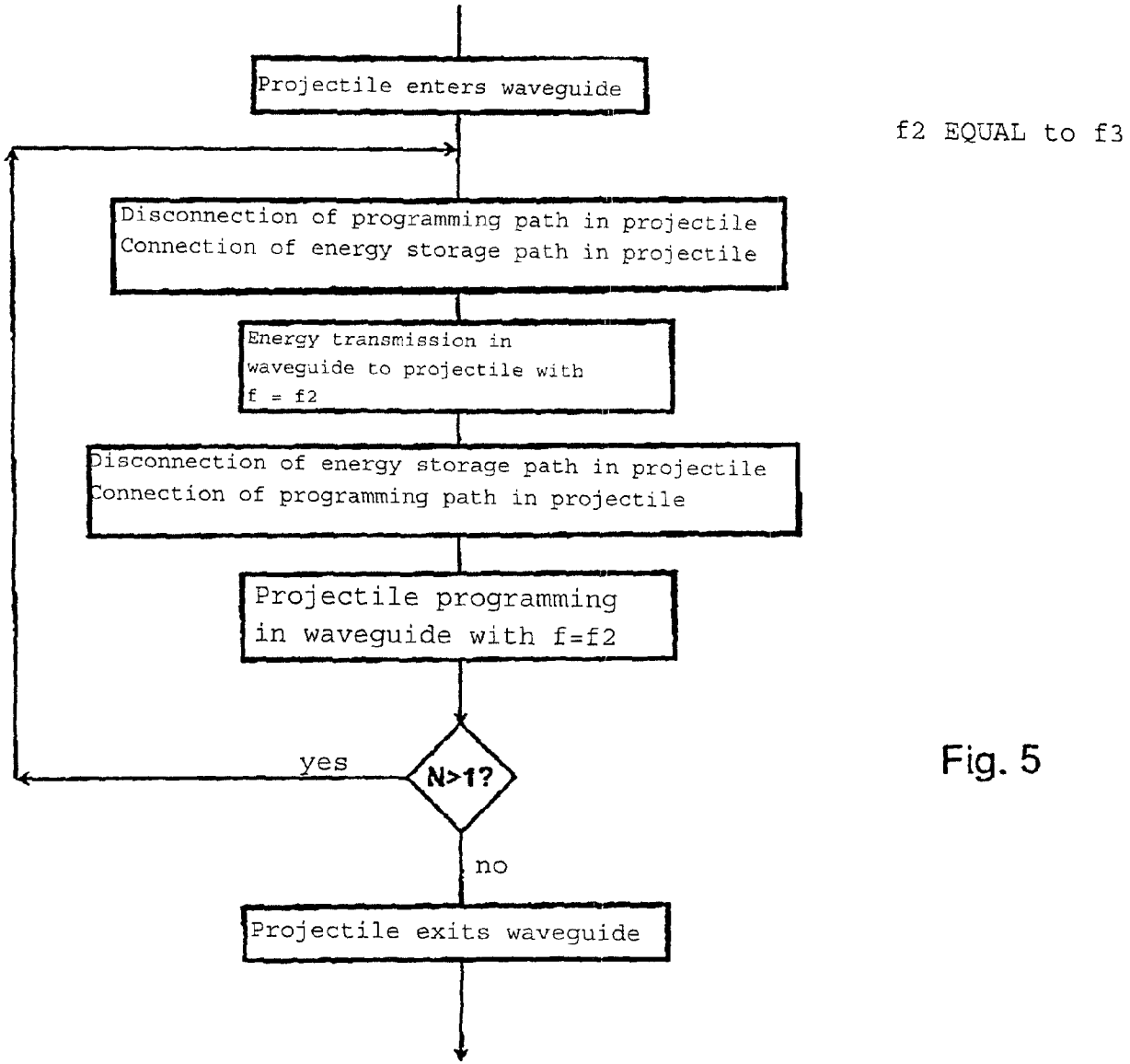

FIG. 4 reflects the programming sequence for the condition $f_2 \neq f_3$. FIG. 5 reflects the programming sequence for the condition $f_2 = f_3$. The structure on the weapon for the programming and energy transmission is not shown in detail (reference is made in this regard to the applicant's two parallel applications).

The projectile or round of ammunition or shell 1 flies into the waveguide, which is not shown in detail. The energy transmission to the projectile 1 within the waveguide HL1 takes place in a first step. Either the bandpass filters 3, 4 are used for this purpose, or the control unit 8 in accordance with the exemplary embodiment in FIG. 2 and FIG. 3. The programming, for example within the waveguide HL2, takes place next. The two said waveguides can also be composed of one and the same waveguide. If multiple arrangements of waveguides are present, and they are passed through sequentially (corresponding to N>1: yes), the process is repeated. Otherwise, the projectile 1 exits the waveguide.

If only one frequency ($f_2=f_3$) is used for the programming as well as the energy transmission, the electrical paths in the projectile 1 must be alternately opened and closed. In the simplest embodiment, this is accomplished by the switch 8 in the round of ammunition. Here, too, multiple waveguides may be present that are passed through sequentially (corresponding to N>1: yes) before the projectile 1 exits the waveguide.

The invention being thus described, it will be obvious that the same may be varied in many ways. Such variations are not to be regarded as a departure from the spirit and scope of the invention, and all such modifications as would be obvious to one skilled in the art are to be included within the scope of the following claims.

What is claimed is:

1. A method for programming and/or transmitting energy to a round of ammunition comprising at least one energy storage device, an electronics unit, a detonator, and at least one sensor, the method comprising:

transmitting energy to the projectile by transmitting a signal with a first frequency;

programming the projectile by transmitting a signal with a second frequency;

routing, from the sensor, the signal with the first frequency to the energy storage device; and routing, from the sensor, the signal with the second frequency, to the electronics unit, wherein both the programming and the energy transmission take place during a passage of the projectile through a gun barrel or a muzzle brake, which are operated as a waveguide below a cutoff frequency.

2. A programmable ammunition, in which programming and energy transmission is performed at least one of inductively or capacitively, comprising:

at least one energy storage device;

an electronics unit;

a detonator; and during a passage of the programmable ammunition through a gun barrel or a muzzle brake, which are operated as a waveguide below a cutoff frequency, at least one sensor configured:

to receive a signal with a first frequency for an energy transmission that is routable to the energy storage device, to receive a signal transmitted for the programming with a second frequency, and to forward this signal to the electronics unit for programming.

* * * * *